US005322421A

United States Patent [19]

Hansen

[11] Patent Number: 5,322,421

[45] Date of Patent: Jun. 21, 1994

[54] COOLING ARRANGEMENT FOR MAGNETIC COUPLINGS IN PUMPS

[75] Inventor: Bent Hansen, Odense, Denmark

[73] Assignee: Thrige Pumper A/S, Odensec, Denmark

[21] Appl. No.: 12,523

[22] Filed: Feb. 2, 1993

[30] Foreign Application Priority Data

Feb. 3, 1992 [DK] Denmark ..... 125/92

[51] Int. Cl.[5] ..... F04B 17/00

[52] U.S. Cl. ..... 417/420; 417/410 C; 418/86

[58] Field of Search ..... 417/420, 410 B, 410 C, 417/201, 505; 418/86

[56] References Cited

U.S. PATENT DOCUMENTS

| | | | |
|---|---|---|---|
| 2,810,348 | 10/1957 | White . | |
| 4,047,847 | 9/1977 | Oikawa | 417/420 |
| 4,111,614 | 9/1978 | Martin et al. | 417/420 |
| 4,127,365 | 11/1978 | Martin et al. | 417/410 C |
| 5,165,868 | 11/1992 | Gergets et al. | 417/420 |

FOREIGN PATENT DOCUMENTS

| | | |
|---|---|---|
| 3413930 | 4/1984 | Fed. Rep. of Germany . |
| 2278957 | 2/1975 | France . |
| 473986 | 4/1968 | Switzerland . |

*Primary Examiner*—Richard A. Bertsch
*Assistant Examiner*—Alfred Basichas
*Attorney, Agent, or Firm*—Antonelli, Terry, Stout & Kraus

[57] ABSTRACT

A gear pump which is fitted with a magnetic coupling (6) to ensure against leaks uses circulation of the pump fluid to cool the magnetic coupling. The circulation is established by supplying the pump rotor (4) with radial channels (24) which terminate in recesses on the periphery of the rotor and which are connected to an axial channel (26) in the rotor shaft leading to the end of the shaft which is nearest the magnetic coupling. The fluid which is drawn through the channels (24) is mixed with the main stream of fluid in a section which is cut out of the wall of the pump chamber (16), and fresh cooling fluid is drawn via the chamber (40) to the radial gap in the magnetic coupling.

7 Claims, 2 Drawing Sheets

COOLING ARRANGEMENT FOR MAGNETIC COUPLINGS IN PUMPS

FIELD OF THE INVENTION

The invention relates to a gear pump, in particular a gear pump with an internal idler gear with a magnetic coupling between the motor and the rotor, and where the rear side of the rotor is shaped in order to bring about an active flow of pump fluid through the magnetic coupling via a system of passageways.

BACKGROUND OF THE INVENTION

Pumps provided with a magnetic coupling between the motor and the rotor are used for pumping liquids, such as chemicals, inflammable liquids, foodstuffs, etc. where it is required or desirable to have a completely leakproof pump.

Partly due to eddy currents in the magnetic coupling caused by the rotation of the permanent magnet and partly because of bearing and hydraulic losses the magnetic coupling may get inadmissibly hot, so that cooling becomes necessary. This is obtained in known constructions by using the pressure drop across the pump to conduct a part of the pump fluid through the coupling. This entails some disadvantages, however, in particular because the viscosities of the pump fluids are in themselves different, they are temperature dependent, and furthermore the pressure drop across the pump varies, so that there is no control of the coolant, i.e. the part of the pump fluid used for cooling. This means that the cooling of the magnetic coupling has to be individually adapted to the specific pump fluid and its temperature. The leakage of pump fluid for cooling purposes means a reduced pump capacity, and there is a pronounced risk that the calibrated opening for the coolant clogs up because of its small size.

SUMMARY OF THE INVENTION

The purpose of the invention is to provide an efficient cooling of the magnetic coupling of a gear pump, in particular a gear pump with an internal idler gear by continuously drawing new pump fluid through the coupling and to aim at independence of the pump capacity, the pressure drop across the pump and the sense of rotation of the pump. Furthermore it is a purpose of the cooling system that there is no increased leakage in the pump and that the stationary fluid passages have such dimensions that clogging is avoided. This is obtained in the invention by fitting the rear side of the rotor in a sealing relationship with a recess in the pump chamber, and that a section is cut out in one side of this recess which leads to the pump chamber in order that pump fluid may flow to the rear of the rotor and further through the system of passageways to the magnetic coupling for cooling. From the magnetic coupling the pump fluid continues through the system of passageways and via the section out into the main stream where the two streams mix. The flow conditions are such that an efficient mixture is obtained in the main stream. The construction is such that the section is placed either at the low pressure or at the high pressure side of the pump. Which side is the high pressure and which is the low pressure side is determined by the sense of rotation of the pump. By disposing the section in this way there is no connection for transporting fluid from the high pressure side to the low pressure side. Hence there is no leakage in the pump caused by the cooling provisions.

In the present construction the section may have sufficient size to allow a good mixing with the cool main stream. The construction permits making the passageways so large as to avoid any risk of clogging.

The present invention proposes shaping the rotor for enabling an active flow of the pump fluid for cooling the magnetic coupling in addition to providing a particular disposition of the passageways.

In accordance with advantageous features of the present invention, the rotor includes at least one channel which extends from an inner end of an axial channel in the rotor shaft and toward a periphery of the rotor, preferably, ending at the periphery and the inlet to the channel of the rotor shaft is placed at the magnetic coupling, preferably, at the far end thereof, in order that, while running, a pumping effect is created in the rotor channels which cause a flow of pumping fluid from the chamber through the magnetic coupling, while the pump fluid is taken in through the channel in the rotor and is returned through the channels in the rotor to the chamber. The pump fluid in the coupling is mixed with the main stream of the pump through a section provided in a wall portion.

According to further features of the present invention, a channel in the rotor shaft is fashioned as a single access or axial channel and the channel or channels in the pump rotor may be disposed so as to extend in a radial direction.

Advantageously, the pump rotor is supplied with four channels which extend at right angles to each other and, the channels may terminate in cut-out portions disposed on a periphery of the rotor.

BRIEF DESCRIPTION OF THE DRAWINGS

An embodiment of the invention will be described in the following with reference to the accompanying drawing wherein. In the drawing

Figure 1:
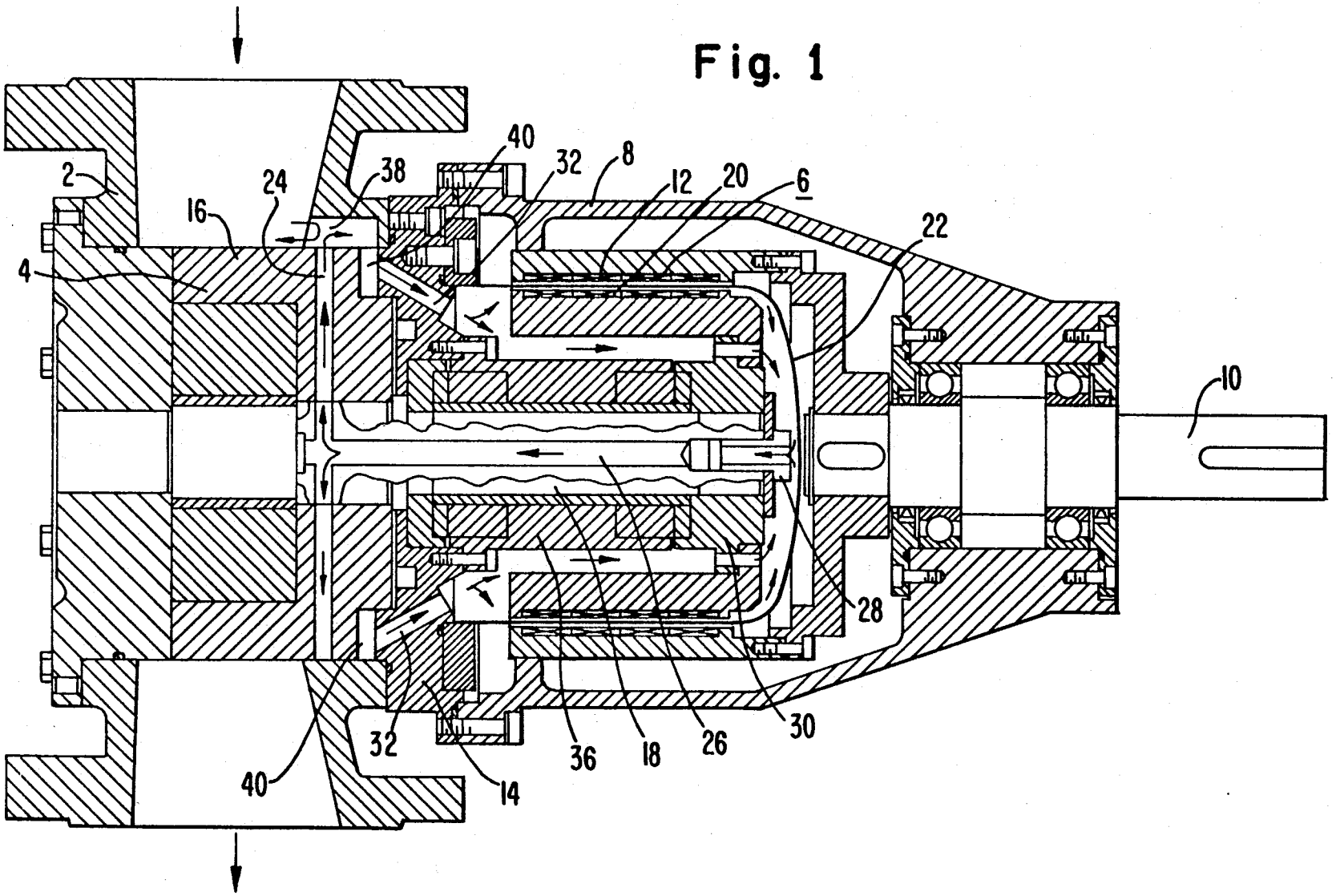
FIG. 1 is a longitudinal section through the pump.
Figure 2:
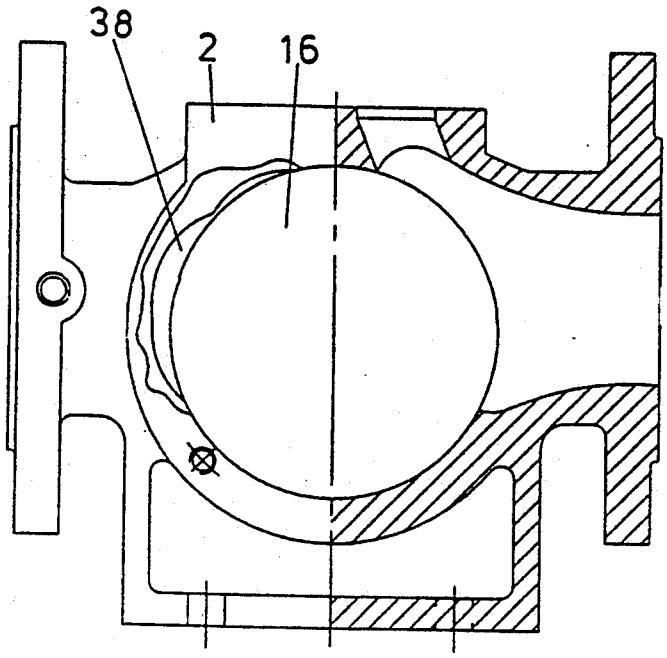
FIG. 2 is a cross section of the pump chamber.
Figure 3:
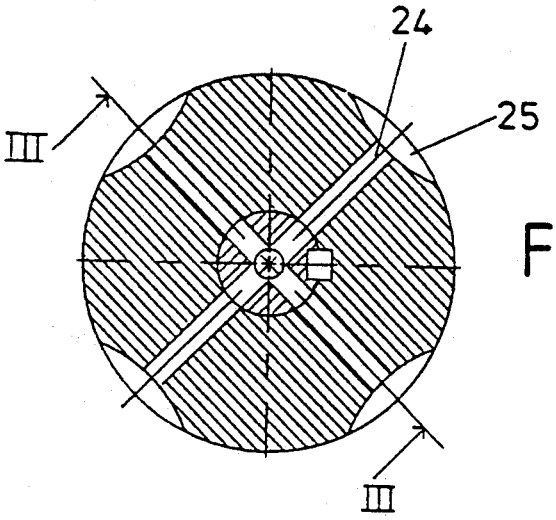
FIG. 3 is a cross section of the rotor.
Figure 4:
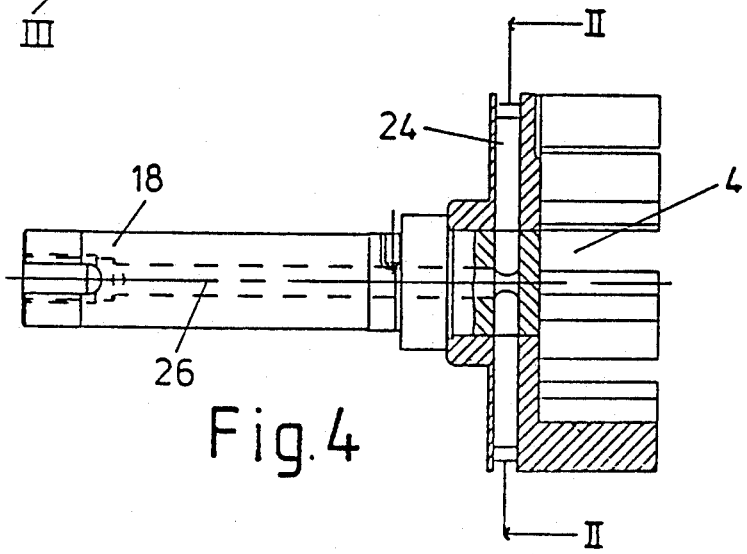
FIG. 4 is a partial cross-sectional view of the rotor longitudinal.

The pump shown in the drawing comprises a pump housing 2 inside which is placed a rotor 4. The rotor is driven by an electric motor which is not shown via a magnetic coupling 6. The pump comprises a bracket 8 in which a shaft 10 for the motor is carried in bearings, and to the other end of the shaft is fitted the outer part 12 of the magnetic coupling. In the pump housing 2 in which the pump chamber 16 is disposed bearings carry the shaft 18 one end of which carries the rotor 4 and the other end of which carries the second, inside part 20 of the magnetic coupling. The two parts of the magnetic coupling are separated by a cap 22 which seals off the fluid part of the pump. In order to cool the magnetic clutch by the pump fluid, four radial channels 24 are formed perpendicular to each other in the rotor which terminate in cut-outs 25.

In the rotor shaft an axial channel 26 connects the end of the shaft near the cap 22 to the the channels in the rotor. The channel is carried through the bolt 28 which holds the sleeve 30 for the inside part of the magnetic coupling. From the pump chamber there is a free passage for the pump fluid into the cap 22 by passageways 32 in the rear cover 14 into which the bearing 36 for the rotor is fitted.

While running, due to centrifugal forces pump fluid in the channels 24 of the rotor will be thrown towards the housing in the pump chamber, and at the periphery of the rotor mixing with the main stream of the pump fluid will take place through a recess 38 cut out in the housing. Due to this, lower pressure will occur in the channel 26 in the rotor shaft, and pump fluid will be drawn through it into the rotor channels. Hence there will be a fluid flow from the section 38 to the chamber 40 through the passageways 32 and into the ringshaped gap between the cap 22 and the inside part 20 of the magnetic coupling, whereby the coupling is cooled. It is noted that it is not essential for the function that the section 38 be provided with a shape identical to that shown in the drawing, there only has to be a connection to the main stream.

By virtue of the features of the present invention there is, in a simple manner provided a cooling of the magnetic coupling which avoids the disadvantages of the known cooling method where the cooling fluid is drawn through the magnetic coupling because of the difference in pressure between the low pressure side and the high pressure side of the pump. Although the invention has been described with respect to a gear pump with an internal idler gear or an internally toothed idler ring, it is equally useful in connection with traditional gear pumps.

I claim:

1. A gear with a magnetic coupling interposed between a motor and a rotor, wherein a rear side of the rotor is shaped so as to provide an active flow of pump fluid through the magnetic coupling through a system of passageways, the rear side of the rotor is rotatably fitted and in a sealing relationship with a housing in a pump chamber, and wherein a recess is cut out in one side of said housing which leads to the pump chamber to enable the pump fluid to flow to a rear of the rotor and further through the system of passageways to the magnetic coupling for cooling the magnetic coupling, and back to said recess into the main stream where a mixing is effected.

2. A pump according to claim 1, wherein the rotor includes at least one channel extending from an inner end of an axial channel in a shaft of the rotor and towards a periphery of the rotor, an inlet to the channel in the rotor shaft is disposed at the magnetic coupling, whereby while the pump is running, a pumping effect is created in the at least one channel of the rotor so as to cause a flow of pump fluid from the pump chamber through the magnetic coupling, while the pump fluid is taken in through the channel in the rotor shaft and is returned through the at least one channel in the rotor to the chamber, and wherein the pump fluid in the magnetic coupling is mixed with a main stream of the pump through the recess in the housing.

3. A pump according to claim 2, wherein the channel in the shaft of the rotor is a single axial channel.

4. A pump according to one of claims 2 or 3, wherein the at least one channel in the rotor extends in a radial direction.

5. A pump according to claim 4, wherein the rotor includes four channels extending at right angles with respect to each other.

6. A pump according to claim 2, wherein the at least one channel terminates in cut outs provided on a periphery of the rotor.

7. A pump according to one of claims 1 or 2, wherein the gear pump includes an internal idler gear.

* * * * *

UNITED STATES PATENT AND TRADEMARK OFFICE

CERTIFICATE OF CORRECTION

PATENT NO. : 5,322,421

DATED : June 21, 1994

INVENTOR(S) : Hansen

It is certified that error appears in the above-identified patent and that said Letters Patent is hereby corrected as shown below:

Column 3, line 29, after "gear" insert --pump--.

Signed and Sealed this

Second Day of April, 1996

Bruce Lehman

*Attest:*

BRUCE LEHMAN

*Attesting Officer*

*Commissioner of Patents and Trademarks*